US012129623B2

(12) United States Patent
Miller et al.

(10) Patent No.: US 12,129,623 B2
(45) Date of Patent: Oct. 29, 2024

(54) SEGMENTED RAM SYSTEMS AND METHODS FOR HYDRAULIC IMPACT HAMMERS

(71) Applicant: American Piledriving Equipment, Inc., Kent, WA (US)

(72) Inventors: Dan Miller, Kent, WA (US); Steven N. Cress, Kent, WA (US); Joseph M. Klekotka, Seattle, WA (US)

(73) Assignee: AMERICAN PILEDRIVING EQUIPMENT, INC., Kent, WA (US)

( * ) Notice: Subject to any disclaimer, the term of this patent is extended or adjusted under 35 U.S.C. 154(b) by 4 days.

(21) Appl. No.: 17/657,325

(22) Filed: Mar. 30, 2022

(65) Prior Publication Data

US 2022/0316168 A1 Oct. 6, 2022

Related U.S. Application Data

(60) Provisional application No. 63/169,010, filed on Mar. 31, 2021.

(51) Int. Cl.
*E02D 7/10* (2006.01)

(52) U.S. Cl.
CPC ..... *E02D 7/10* (2013.01)

(58) Field of Classification Search
CPC .... E02D 7/02; E02D 7/06; E02D 7/08; E02D 7/10
USPC ..... 173/84, 89, 131
See application file for complete search history.

(56) References Cited

U.S. PATENT DOCUMENTS

| | | | | |
|---|---|---|---|---|
| 5,015 | A | | 3/1847 | Ingalls |
| 48,515 | A | | 7/1865 | Campbell et al. |
| 369,176 | A | | 8/1887 | Gerstein |
| 400,209 | A | | 3/1889 | Haskins |
| 500,780 | A | | 7/1893 | Simon |
| 628,962 | A | | 7/1899 | Speer |
| 696,480 | A | * | 4/1902 | Pierce |
| 870,762 | A | * | 11/1907 | Burge |

(Continued)

FOREIGN PATENT DOCUMENTS

| | | | |
|---|---|---|---|
| CA | 2394894 | A1 | 8/2003 |
| CA | 2942801 | A1 | 10/2015 |

(Continued)

OTHER PUBLICATIONS

DT 2526889 (Year: 1975).*

(Continued)

*Primary Examiner* — Sunil Singh
(74) *Attorney, Agent, or Firm* — Schacht Law Office, Inc.; Michael R. Schacht

(57) ABSTRACT

A ram assembly comprises a top plate defining one or more clamp openings and one or more top plate lift openings, a bottom plate defining one or more anchor openings, a lift plate defining one or more lift plate ram cable openings, and one or more ram wire rope assemblies. Each ram wire rope assembly extends through one lift plate ram cable opening and between one clamp opening and one anchor opening to inhibit movement of the top plate, the bottom plate, and the lift plate relative to each other. The top plate lift opening is sized and dimensioned to allow at least a portion of the actuator rod assembly to extend through the top plate. The lift plate is adapted to be secured relative to the actuator rod assembly.

15 Claims, 8 Drawing Sheets

(56) References Cited

U.S. PATENT DOCUMENTS 910,421 A 1/1909 Schlueter
999,334 A 8/1911 Robert
1,103,104 A 7/1914 Tismer
1,128,808 A 2/1915 Manoogian
1,159,303 A 11/1915 Waugh
1,213,800 A 1/1917 Piper
1,288,989 A 12/1918 Rees
1,294,154 A 2/1919 Payne
1,322,470 A 11/1919 Schenk
1,348,994 A 8/1920 Heckle
1,464,231 A 8/1923 Yezek
1,654,093 A 12/1927 Reid
1,684,816 A 9/1928 Arden
1,702,349 A 2/1929 Krell
1,748,555 A 2/1930 Kinney
1,762,037 A 6/1930 Taylor
1,769,169 A 7/1930 Thornley
1,787,000 A 12/1930 Hunt
1,903,555 A 4/1933 Robertson
1,914,899 A 6/1933 Syme
1,988,173 A 1/1935 Kersting
2,068,045 A 1/1937 Wohlmeyer
2,101,285 A 12/1937 Stevens
2,128,428 A 8/1938 Murray, Jr.
2,232,845 A 2/1941 Fieroh
2,239,024 A 4/1941 Vance
2,345,795 A 4/1944 Curtis
2,350,921 A 6/1944 Pinazza
2,436,251 A 2/1948 Dobie et al.
2,439,219 A 4/1948 O'Connor
2,577,252 A 12/1951 Kjellman
2,723,532 A 11/1955 Smith
2,755,783 A 7/1956 Kupka
2,760,747 A 8/1956 Mordarski
2,804,856 A 9/1957 Spurlin
2,842,972 A 7/1958 Houdart
2,859,628 A 11/1958 Arko
2,882,690 A 4/1959 Frederick
2,904,964 A 9/1959 Kupka
2,952,132 A 9/1960 Urban
2,975,846 A 3/1961 Bodine
3,001,515 A 9/1961 Haage
3,004,389 A 10/1961 Muller
3,034,304 A 5/1962 Upson
3,059,436 A 10/1962 Hermann, Jr.
3,094,007 A 6/1963 Luhrs
3,100,382 A 8/1963 Muller
3,101,552 A 8/1963 Tandler
3,106,258 A 10/1963 Muller
3,108,503 A 10/1963 Murek
3,115,198 A 12/1963 Kuss
3,149,851 A 9/1964 Adams
3,172,485 A 3/1965 Spannhake et al.
3,175,630 A 3/1965 Hein et al.
3,177,029 A 4/1965 Larson
3,193,026 A 7/1965 Kupka
3,227,483 A 1/1966 Guild et al.
3,243,190 A 3/1966 Peregrine
3,267,677 A 8/1966 Bollar
3,278,235 A 10/1966 Bergstrom
3,280,924 A 10/1966 Tatarnikov
3,287,983 A 11/1966 Austin et al.
3,289,774 A 12/1966 Bodine, Jr.
3,300,987 A 1/1967 Maeda
3,313,376 A 4/1967 Holland
3,371,727 A 3/1968 Belousov et al.
3,375,881 A * 4/1968 Myers ..... E02D 7/08
173/210
3,381,422 A 5/1968 Olson
3,391,435 A 7/1968 Lebelle
3,394,766 A 7/1968 Lebelle
3,396,805 A 8/1968 Muller
3,411,305 A 11/1968 Cella
3,412,813 A 11/1968 Johnson
3,447,423 A 6/1969 Henry
3,450,398 A 6/1969 Barnes
3,460,637 A 8/1969 Schulin
3,513,587 A 5/1970 Artur
3,528,302 A 9/1970 Kinnan
3,530,947 A 9/1970 Gendron
3,577,645 A 5/1971 Zurawski
3,583,497 A 6/1971 Kossowski et al.
3,616,453 A 10/1971 Philpot
3,620,137 A 11/1971 Prasse
3,638,738 A 2/1972 Varnell
3,679,005 A 7/1972 Inaba et al.
3,684,037 A 8/1972 Bodine
3,686,877 A 8/1972 Bodin
3,711,161 A 1/1973 Proctor et al.
3,720,435 A 3/1973 Leyn
3,734,209 A 5/1973 Haisch et al.
3,786,874 A 1/1974 Demichelis et al.
3,789,930 A 2/1974 Nishimura et al.
3,797,585 A 3/1974 Ludvigson
3,808,820 A 5/1974 Bodine
3,822,969 A 7/1974 Kummel
3,828,864 A 8/1974 Haverkamp et al.
3,854,418 A 12/1974 Bertin
3,861,664 A 1/1975 Durkee
3,865,501 A 2/1975 Kniep
3,871,617 A 3/1975 Majima
3,874,244 A 4/1975 Rasmussen et al.
3,891,186 A 6/1975 Thorsell
3,907,042 A 9/1975 Halwas et al.
3,909,149 A 9/1975 Century
3,952,796 A 4/1976 Larson
3,959,557 A 5/1976 Berry
3,967,688 A 7/1976 Inenaga et al.
3,975,918 A 8/1976 Jansz
3,991,833 A 11/1976 Ruppert
3,998,063 A 12/1976 Harders
3,999,392 A 12/1976 Fukushima et al.
4,018,290 A 4/1977 Schmidt
4,029,158 A 6/1977 Gerrish
4,033,419 A 7/1977 Pennington
4,067,369 A 1/1978 Harmon
4,076,081 A 2/1978 Schnell
4,082,361 A 4/1978 Lanfermann
4,099,387 A 7/1978 Frederick et al.
4,100,974 A 7/1978 Pepe
4,102,408 A 7/1978 Ludvigson
4,109,475 A 8/1978 Schnell
4,113,034 A 9/1978 Carlson
4,119,159 A 10/1978 Arentsen
4,143,985 A 3/1979 Axelsson et al.
4,144,939 A 3/1979 Knothe
4,154,307 A 5/1979 Gendron et al.
4,155,600 A 5/1979 Lanfermann et al.
4,166,508 A 9/1979 van den Berg
4,180,047 A 12/1979 Bertelson
4,187,917 A 2/1980 Bouyoucos
4,195,698 A 4/1980 Nakagawasai
4,248,550 A 2/1981 Blaschke et al.
4,262,755 A 4/1981 Kuhn
4,274,761 A 6/1981 Boguth
4,285,405 A 8/1981 Weir
4,297,056 A 10/1981 Nottingham
4,312,413 A 1/1982 Loftis
4,351,624 A 9/1982 Barber
4,362,216 A 12/1982 Jansz
4,366,870 A 1/1983 Frederick
4,367,800 A 1/1983 Arentsen
4,375,927 A 3/1983 Kniep
4,380,918 A 4/1983 Killop
4,382,475 A 5/1983 Suzuki
4,397,199 A 8/1983 Jahn
4,421,180 A 12/1983 Fleishman et al.
4,428,699 A 1/1984 Juhola
4,430,024 A 2/1984 Guild et al.
4,436,452 A 3/1984 Bodine
4,455,105 A 6/1984 Juhola
4,465,145 A 8/1984 Kuhn
4,473,123 A 9/1984 Ranft et al.
4,484,638 A 11/1984 West

(56) References Cited

U.S. PATENT DOCUMENTS

| | | | |
|---|---|---|---|
| 4,497,376 | A | 2/1985 | Kurylko |
| 4,497,377 | A | 2/1985 | Haytayan |
| 4,505,614 | A | 3/1985 | Anschutz |
| 4,519,729 | A | 5/1985 | Clarke et al. |
| 4,522,304 | A | 6/1985 | Walter |
| 4,537,527 | A | 8/1985 | Juhola et al. |
| 4,547,110 | A | 10/1985 | Davidson |
| 4,553,443 | A | 11/1985 | Rossfelder et al. |
| 4,601,615 | A | 7/1986 | Cavalli |
| 4,603,748 | A | 8/1986 | Rossfelder et al. |
| 4,606,427 | A | 8/1986 | Beer |
| 4,616,716 | A | 10/1986 | Bouplon |
| 4,624,325 | A | 11/1986 | Steiner |
| 4,625,811 | A | 12/1986 | Tuenkers |
| 4,626,138 | A | 12/1986 | Boyes |
| 4,627,768 | A | 12/1986 | Thomas et al. |
| 4,632,602 | A | 12/1986 | Hovnanian |
| 4,637,475 | A | 1/1987 | England et al. |
| 4,645,017 | A | 2/1987 | Bodine |
| 4,650,008 | A | 3/1987 | Simson |
| 4,687,026 | A | 8/1987 | Westman |
| 4,725,167 | A | 2/1988 | Merjan |
| 4,735,270 | A | 4/1988 | Fenyvesi |
| 4,755,080 | A | 7/1988 | Cortlever et al. |
| 4,757,809 | A | 7/1988 | Koeneman et al. |
| 4,758,148 | A | 7/1988 | Jidell |
| 4,768,900 | A | 9/1988 | Burland |
| 4,799,557 | A | 1/1989 | Jacquemet |
| 4,813,814 | A | 3/1989 | Shibuta et al. |
| 4,819,740 | A | 4/1989 | Warrington |
| 4,844,661 | A | 7/1989 | Martin et al. |
| 4,863,312 | A | 9/1989 | Cavalli |
| 4,877,353 | A | 10/1989 | Wisotsky |
| 4,915,180 | A | 4/1990 | Schisler |
| 4,961,471 | A | 10/1990 | Ovens |
| 4,974,997 | A | 12/1990 | Sero et al. |
| 4,989,677 | A | 2/1991 | Lam |
| 4,993,500 | A | 2/1991 | Greene et al. |
| 5,004,055 | A | 4/1991 | Porritt et al. |
| 5,018,251 | A | 5/1991 | Brown |
| 5,018,905 | A | 5/1991 | Kinder |
| 5,076,090 | A | 12/1991 | Cetnarowski |
| 5,088,565 | A | 2/1992 | Evarts |
| 5,106,233 | A | 4/1992 | Breaux |
| 5,107,934 | A | 4/1992 | Atchison |
| 5,117,925 | A | 6/1992 | White |
| 5,154,667 | A | 10/1992 | Mauch et al. |
| 5,161,625 | A | 11/1992 | Seng |
| 5,213,449 | A | 5/1993 | Morris |
| 5,240,348 | A | 8/1993 | Breaux |
| 5,244,316 | A | 9/1993 | Wright et al. |
| 5,253,542 | A | 10/1993 | Houze |
| RE34,460 | E | 11/1993 | Ishiguro et al. |
| 5,263,544 | A | 11/1993 | White |
| 5,281,775 | A | 1/1994 | Gremillion |
| 5,343,002 | A | 8/1994 | Gremillion |
| 5,355,964 | A | 10/1994 | White |
| 5,375,897 | A | 12/1994 | Gazel-Anthoine |
| 5,385,218 | A | 1/1995 | Migliori |
| 5,388,931 | A | 2/1995 | Carlson |
| 5,409,070 | A | 4/1995 | Roussy |
| 5,410,879 | A | 5/1995 | Houze |
| 5,423,633 | A | 6/1995 | Verstraeten |
| 5,439,326 | A | 8/1995 | Goughnour et al. |
| 5,526,885 | A | 6/1996 | Kuvshinov et al. |
| 5,529,132 | A | 6/1996 | Evarts |
| 5,540,193 | A | 7/1996 | Achten et al. |
| 5,540,295 | A | 7/1996 | Serrette |
| 5,544,979 | A | 8/1996 | White |
| 5,549,168 | A | 8/1996 | Sadler et al. |
| 5,549,170 | A | 8/1996 | Barrow |
| 5,551,804 | A | 9/1996 | Breaux et al. |
| 5,562,169 | A | 10/1996 | Barrow |
| 5,609,380 | A | 3/1997 | White |
| 5,653,556 | A | 8/1997 | White |
| 5,658,091 | A | 8/1997 | Goughnour et al. |
| 5,727,639 | A | 3/1998 | Jeter |
| 5,788,419 | A | 8/1998 | Whitty, Jr. et al. |
| 5,794,716 | A | 8/1998 | White |
| 5,800,096 | A | 9/1998 | Barrow |
| 5,806,610 | A | 9/1998 | Sapozhnikov |
| 5,811,741 | A | 9/1998 | Coast et al. |
| 5,836,205 | A | 11/1998 | Meyer |
| 5,860,482 | A | 1/1999 | Gremillion et al. |
| 5,918,511 | A | 7/1999 | Sabbaghian et al. |
| 5,924,498 | A | 7/1999 | Nilsen |
| 5,934,835 | A | 8/1999 | Whitty, Jr. et al. |
| 6,003,619 | A | 12/1999 | Lange |
| 6,039,508 | A | 3/2000 | White |
| 6,056,070 | A | 5/2000 | Shinohara et al. |
| 6,102,133 | A | 8/2000 | Scheid et al. |
| 6,129,159 | A | 10/2000 | Scott et al. |
| 6,129,487 | A | 10/2000 | Bermingham et al. |
| 6,135,214 | A | 10/2000 | Last |
| 6,155,353 | A | 12/2000 | Ottestad |
| 6,179,527 | B1 | 1/2001 | Goughnour |
| 6,186,043 | B1 | 2/2001 | Callies |
| 6,216,394 | B1 | 4/2001 | Fenelon |
| 6,224,294 | B1 | 5/2001 | Mansfield |
| 6,227,767 | B1 | 5/2001 | Mosing et al. |
| 6,234,260 | B1 | 5/2001 | Coast et al. |
| 6,250,426 | B1 | 6/2001 | Lombard |
| 6,360,829 | B1 | 3/2002 | Naber et al. |
| 6,364,577 | B1 | 4/2002 | Haney |
| 6,378,951 | B1 | 4/2002 | Bouyoucos et al. |
| 6,386,295 | B1 | 5/2002 | Suver |
| 6,394,704 | B1 | 5/2002 | Saeki et al. |
| 6,427,402 | B1 | 8/2002 | White |
| 6,431,795 | B2 | 8/2002 | White |
| 6,447,036 | B1 | 9/2002 | White |
| 6,484,553 | B1 | 11/2002 | Devers |
| 6,543,966 | B2 | 4/2003 | White |
| 6,557,647 | B2 | 5/2003 | White |
| 6,582,158 | B1 | 6/2003 | Van Stein |
| 6,648,556 | B1 | 11/2003 | White |
| 6,652,194 | B2 | 11/2003 | Ingle |
| 6,672,805 | B1 | 1/2004 | White |
| 6,691,797 | B1 | 2/2004 | Hart |
| 6,732,483 | B1 | 5/2004 | White |
| 6,736,218 | B1 | 5/2004 | White |
| 6,752,043 | B2 | 6/2004 | Carlson |
| 6,860,338 | B2 | 3/2005 | Salesse et al. |
| 6,896,448 | B1 | 5/2005 | White |
| 6,908,262 | B1 | 6/2005 | White |
| 6,938,704 | B2 | 9/2005 | Berger et al. |
| 6,942,430 | B1 | 9/2005 | Suver |
| 6,988,564 | B2 | 1/2006 | White |
| 7,011,156 | B2 | 3/2006 | Gynz-Rekowski |
| 7,043,806 | B2 | 5/2006 | Schrock et al. |
| 7,080,958 | B1 | 7/2006 | Morris |
| 7,156,190 | B2 | 1/2007 | Ottestad et al. |
| 7,168,890 | B1 | 1/2007 | Evarts |
| 7,392,855 | B1 | 7/2008 | White |
| 7,404,449 | B2 | 7/2008 | Bermingham et al. |
| 7,407,343 | B2 | 8/2008 | van Halteren et al. |
| 7,591,612 | B2 | 9/2009 | Wong |
| 7,694,747 | B1 | 4/2010 | White |
| 7,708,499 | B1 | 5/2010 | Evarts et al. |
| 7,726,913 | B1 | 6/2010 | Sjogren |
| 7,824,132 | B1 | 11/2010 | White |
| 7,854,571 | B1 | 12/2010 | Evarts |
| 7,914,236 | B2 | 3/2011 | Neville |
| 7,950,877 | B2 | 5/2011 | Evarts |
| 7,972,083 | B2 | 7/2011 | Jones |
| 8,070,391 | B2 | 12/2011 | White |
| 8,181,713 | B2 | 5/2012 | White |
| 8,181,716 | B2 | 5/2012 | Robson |
| 8,186,452 | B1 | 5/2012 | White et al. |
| 8,434,969 | B2 | 5/2013 | White |
| 8,496,072 | B2 | 7/2013 | White |
| 8,763,719 | B2 | 7/2014 | White |
| 9,249,551 | B1 | 2/2016 | White |
| 9,255,375 | B2 | 2/2016 | Yingling et al. |
| 9,278,443 | B2 | 3/2016 | Robson |

(56) References Cited

U.S. PATENT DOCUMENTS

| | | | |
|---|---|---|---|
| 9,371,624 | B2 | 6/2016 | Suver et al. |
| 9,611,610 | B2 | 4/2017 | Suver |
| 9,957,684 | B2 | 5/2018 | Suver et al. |
| 10,273,646 | B2 | 4/2019 | Cress |
| 10,538,892 | B2 | 1/2020 | Cress et al. |
| 2001/0002230 | A1 | 5/2001 | White |
| 2002/0139550 | A1 | 10/2002 | Mewes |
| 2003/0143036 | A1 | 7/2003 | Larsen et al. |
| 2005/0013675 | A1 | 1/2005 | Bengston et al. |
| 2005/0039952 | A1 | 2/2005 | Hill et al. |
| 2005/0232708 | A1 | 10/2005 | White |
| 2006/0052818 | A1 | 3/2006 | Drake et al. |
| 2006/0113456 | A1 | 6/2006 | Miller |
| 2006/0198706 | A1 | 9/2006 | Neville |
| 2006/0216118 | A1 | 9/2006 | Wong et al. |
| 2008/0310923 | A1 | 12/2008 | Jinnings et al. |
| 2009/0129870 | A1 | 5/2009 | Jones |
| 2010/0266344 | A1 | 10/2010 | Plotkin et al. |
| 2010/0303552 | A1 | 12/2010 | Yingling et al. |
| 2011/0162859 | A1 | 7/2011 | White |
| 2011/0243668 | A1 | 10/2011 | White |
| 2011/0252610 | A1 | 10/2011 | Evarts |
| 2012/0114424 | A1 | 5/2012 | White |
| 2012/0292062 | A1 | 11/2012 | White |
| 2013/0149040 | A1 | 6/2013 | Evarts |
| 2014/0056652 | A1 | 2/2014 | Suver |
| 2014/0231115 | A1 | 8/2014 | Heichel |
| 2014/0377011 | A1 | 12/2014 | Mngling et al. |
| 2015/0016893 | A1 | 1/2015 | Suver et al. |
| 2016/0356294 | A1 | 12/2016 | Fenwick et al. |
| 2017/0101759 | A1 | 4/2017 | Suver |
| 2017/0138133 | A1 | 5/2017 | Fenwick |
| 2017/0167102 | A1 | 6/2017 | Suver et al. |
| 2017/0167104 | A1 | 6/2017 | Cress |
| 2018/0002886 | A1 | 1/2018 | Cress et al. |

FOREIGN PATENT DOCUMENTS

| | | | |
|---|---|---|---|
| CN | 2538852 | Y | 3/2003 |
| CN | 101182714 | A | 5/2008 |
| CN | 102296608 | B | 12/2011 |
| CN | 107558472 | A | 1/2018 |
| CN | 115142413 | A | 10/2022 |
| DE | 4010357 | A1 | 10/1990 |
| DE | 4414190 | C1 | 7/1995 |
| DE | 102006053482 | A1 | 6/2008 |
| EP | 0172960 | A1 | 3/1986 |
| EP | 0362158 | A2 | 4/1990 |
| EP | 0526743 | B1 | 2/1993 |
| FR | 838717 | A | 3/1939 |
| FR | 2560247 | A1 | 8/1985 |
| GB | 529328 | A * | 5/1939 |
| GB | 1066727 | A | 4/1967 |
| GB | 2003769 | A | 3/1979 |
| GB | 2023496 | A | 1/1980 |
| GB | 2028902 | A | 3/1980 |
| GB | 2043755 | A | 10/1980 |
| GB | 2060742 | A | 5/1981 |
| GB | 2069659 | A | 8/1981 |
| JP | 5494703 | | 7/1979 |
| JP | 355098526 | | 7/1980 |
| JP | 356034828 | | 4/1981 |
| JP | 57169130 | | 10/1982 |
| JP | 59228529 | A | 12/1984 |
| JP | 61221416 | | 10/1986 |
| JP | HEI258627 | | 2/1990 |
| JP | 497015 | A | 3/1992 |
| JP | 473035 | | 6/1992 |
| JP | 5246681 | | 9/1993 |
| JP | 6136751 | | 5/1994 |
| JP | 9328983 | A | 12/1997 |
| JP | 2005256500 | A | 9/2005 |
| JP | 2005315050 | A | 11/2005 |
| JP | 2006089933 | A | 4/2006 |
| JP | 2006177125 | A | 7/2006 |
| JP | 2006312825 | A | 11/2006 |
| JP | 2009138487 | A | 6/2009 |
| KR | 1020010044658 | A | 5/2001 |
| KR | 1020030017742 | A | 4/2003 |
| NL | 42349 | C | 1/1938 |
| NL | 65252 | C | 2/1950 |
| NL | 7710385 | A | 3/1978 |
| NL | 7707303 | A | 1/1979 |
| NL | 7805153 | A | 11/1979 |
| NO | 46428 | A | 4/1929 |
| RU | 2109881 | C1 | 4/1998 |
| SU | 1027357 | A1 | 7/1983 |
| WO | 8707673 | A1 | 12/1987 |
| WO | WO8707673 | | 12/1987 |
| WO | 8805843 | A1 | 8/1988 |
| WO | WO8805843 | | 8/1988 |
| WO | 9600326 | A1 | 1/1996 |
| WO | 2012031108 | A1 | 3/2012 |

OTHER PUBLICATIONS

Hydraulic Impact Hammer, Owner's Manual, undated.*

"Castle Board Drain Method", Japanese brochure, Reference Nos. APE00857 through APE00863, Aug. 1976.

"Kony Drain Board," undated, 1 page.

"The 1.sup.st Report on the Treatment of Soft Foundation of Juck Hyun Industrial Site", Ref. Nos. APE00854 through APE00856, Mar. 1976.

A series of photographs identified by reference Nos. APE01147 through APE01159. 1990-1993.

American Piledriving Equipment, Ape Model 10-4 Hydraulic Impact Hammer, 1 page, https://www.americanpiledriving. com/ver2/MvcSpecifications/Hih/Display/2.

American Piledriving Equipment, Inc., A series of photographs identified by Reference Nos. APE01147-APE01159, undated, 13 pages.

APE, "APE Model 8 Hydraulic Impact Hammer," 2000, 1 page.

CCPIT Patent and Trademark Law Office, Office Action and Search Report, Application No. 201210346475.7, Apr. 27, 2015, 15 pages.

International Construction Equipment, Inc "Hydraulic Vibratory Driver/Extractors for Piling and Caisson Work," 10 pages.

International Construction Equipment, Inc "Hydraulic Vibratory Driver/Extractors for Piling and Caisson Work," Ref. No. V7-0890-51, 1974, 3 pages.

International Construction Equipment, Inc., "Diesel Pile Hammers" brochure, Ref. No. DH4-1288-5C, undated, 6 pages.

International Searching Authority, "International Search Report", Jan. 28, 2011, 11 pages.

Japan Development Consultants, Inc., "Castle Board Drain Method" Japanese language brochure, Ref. Nos. APE00857-APE00863, Aug. 1976, 6 pages.

Junttan, Hhka-Series, Hydraulic Impact Hammer, 3 pages, https://junttan.com/product/hhka-series/.

MKT Corporation, "Operating, Maintenance and Parts Manual for MS350 and MS500 Single-Acting Pile Hammers," 12 pages.

Schematic drawings identified by Ref. Nos. APE01038, APE01039, and APE0339, (undated).

Shanghai Jintai SEMW, undated, 8 pages.

USPTO, "Final Office Action, U.S. Appl. No. 15/285,326,", Apr. 25, 2018, 9 pages.

USPTO, "Non-FInal Office Action, U.S. Appl. No. 15/285,326,", Apr. 25, 2017, 10 pages.

USPTO, "Non-Final Office Action, U.S. Appl. No. 15/285,326,", dated Apr. 25, 2017, 10 pages.

USPTO, "Non-Final Office Action, U.S. Appl. No. 15/199,695," Sep. 19, 2018, 18 pages.

USPTO, "Non-Final Office Action, U.S. Appl. No. 15/285,326," Dec. 28, 2017, 17 pages.

USPTO, "Non-Final Office Action, U.S. Appl. No. 15/372,196," Oct. 4, 2017, 23 pages.

www.mmsonline.com/columns/micro-keying-keeps-a-better-grip.aspx, Seibert, Stan, Modern Machine Shop: "Micro-Keying Keeps a Better Grip," Aug. 1, 1992, 2 pages.

(56) References Cited

OTHER PUBLICATIONS

Korean document, Ref. Nos. APE00864 through APE00891, 1982-1997.
Report identifying systems for driving mandrels carrying wick drain material into the earth, Ref. Nos. APE0510-APE0536, undated, 27 pages.

* cited by examiner

SEGMENTED RAM SYSTEMS AND METHODS FOR HYDRAULIC IMPACT HAMMERS

RELATED APPLICATIONS

This application. U.S. patent application Ser. No. 17/657,325 filed Mar. 30, 2022, claims benefit of U.S. Provisional Application Ser. No. 63/169,010 filed Mar. 31, 2021, the contents of which are incorporated herein by reference.

TECHNICAL FIELD

The present invention relates to hydraulic impact hammers and, more specifically, to segmented ram systems and methods that allow a total weight of a hydraulic impact hammer to be altered.

BACKGROUND

Hydraulic impact hammers are configured to drive piles and other elongate members into the earth. Hydraulic impact hammers typically comprise a hydraulic lifting cylinder, a ram, and a cage. The cage supports the lifting cylinder and the ram. The cage guides the ram for movement along an impact axis. The lifting cylinder is configured to lift and release the ram such that the ram falls and impacts an elongate member, such as a pipe pile, supported below the cage and along the impact axis.

A class of hydraulic impact hammers allows the ram to be reconfigured as an adjustable ram assembly, where the weight of the ram assembly and thus the total weight of the hydraulic impact hammer may be altered or adjusted. Hydraulic impact hammers with adjustable ram assemblies allow the hydraulic impact hammer to be adapted for a specific set of driving conditions such as soil content and type and dimensions of pile being driven.

Adjustable ram assemblies used by hydraulic impact hammers comprise a plurality of individual weight members or plates that can be combined to obtain a desired total weight of the hydraulic impact hammer. Conventionally, the weight members or plates of an adjustable ram assembly are welded or bolted together to form a rigid ram member.

The need exists for improved adjustable ram assemblies for hydraulic impact hammers.

SUMMARY

The present invention may be embodied as a ram assembly for use by a system for driving elongate members into the earth comprising an actuator rod assembly. The ram assembly comprises a top plate defining at least one clamp opening and at least one top plate lift opening, a bottom plate defining at least one anchor opening, a lift plate defining at least one lift plate ram cable opening, and at least one ram wire rope assembly. The at least one ram wire rope assembly extends through at least one lift plate ram cable opening and between at least one clamp opening and at least one anchor opening to inhibit movement of the top plate, the bottom plate, and the lift plate relative to each other. The at least one top plate lift opening is sized and dimensioned to allow at least a portion of the actuator rod assembly to extend through the top plate. The lift plate is adapted to be secured relative to the actuator rod assembly.

The present invention may also be embodied as a method of driving elongate members into the earth comprising the following steps. A top plate defining at least one clamp opening and at least one top plate lift opening is provided. A bottom plate defining at least one anchor opening is provided. A lift plate defining at least one lift plate ram cable opening is provided. At least one ram wire rope assembly is arranged to extend through at least one lift plate ram cable opening and between at least one clamp opening and at least one anchor opening to inhibit movement of the top plate, the bottom plate, and the lift plate relative to each other. At least a portion of the actuator rod assembly is arranged to extend through the at least one top plate lift opening. The lift plate is secured relative to the actuator rod assembly.

The present invention may also be embodied as a system for driving elongate members into the earth comprising a hydraulic impact hammer and a ram assembly. The hydraulic impact hammer comprises a cage assembly and an actuator assembly comprising an actuator and an actuator rod assembly. The ram assembly comprises a top plate, a bottom plate, a lift plate, and at least one wire rope assembly. The top plate defines at least one clamp opening, at least one top plate lift opening, and at least one top plate cage opening. The bottom plate defines at least one anchor opening and at least one bottom plate cage opening. The lift plate defines at least one lift plate ram cable opening and at least one lift plate cage opening. The at least one ram wire rope assembly extends through at least one lift plate ram cable opening and between at least one clamp opening and at least one anchor opening to inhibit movement of the top plate, the bottom plate, and the lift plate relative to each other. At least a portion of the cage assembly extends through at least one top plate cage opening, at least one bottom plate cage opening, and at least one lift plate cage opening to allow movement of the ram assembly relative to the cage assembly. The at least one top plate lift opening is sized and dimensioned to allow at least a portion of the actuator rod assembly to extend through the top plate. The lift plate is adapted to be secured relative to the actuator rod assembly.

DETAILED DESCRIPTION

Figure 1:
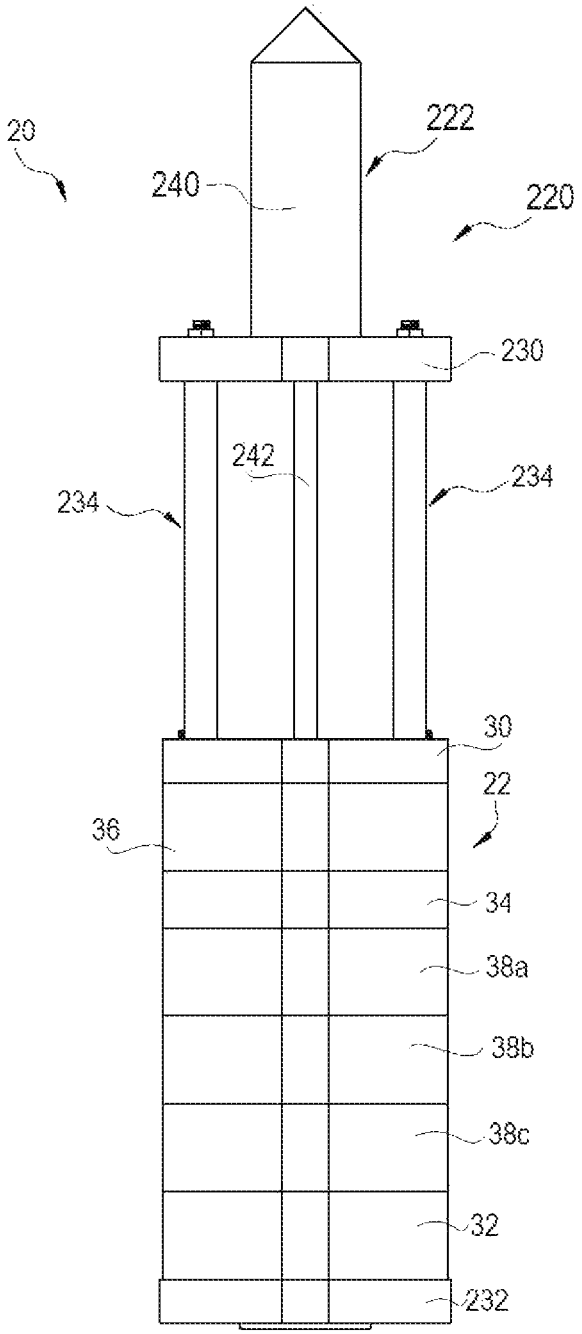
FIG. 1 is a front elevation cutaway view of a first example hydraulic impact hammer comprising a first example ram assembly of the present invention.
Figure 2:
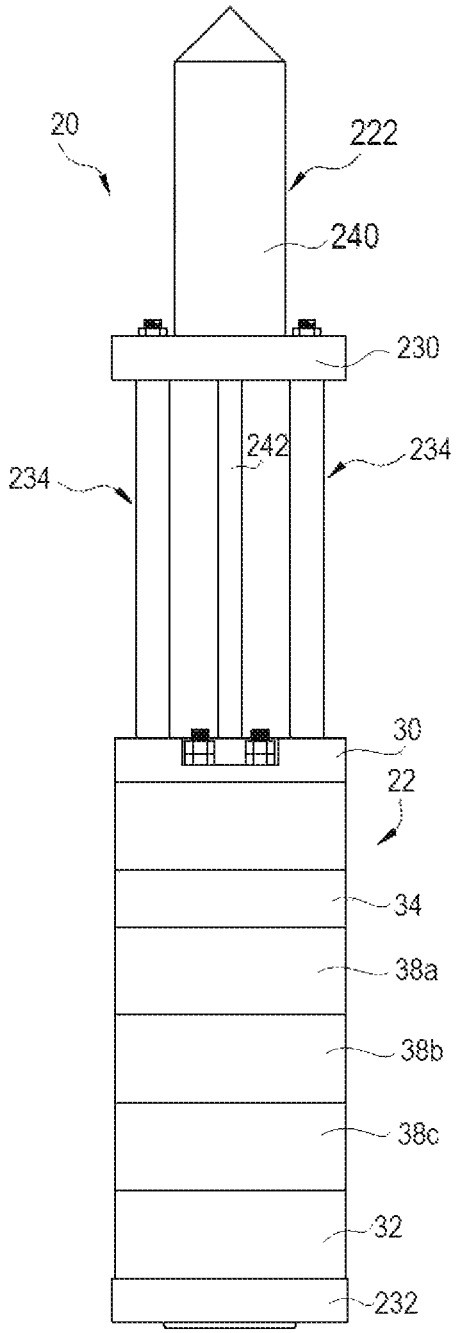
FIG. 2 is a side elevation view of the first example hydraulic impact hammer and the first example ram assembly.
Figure 3D:
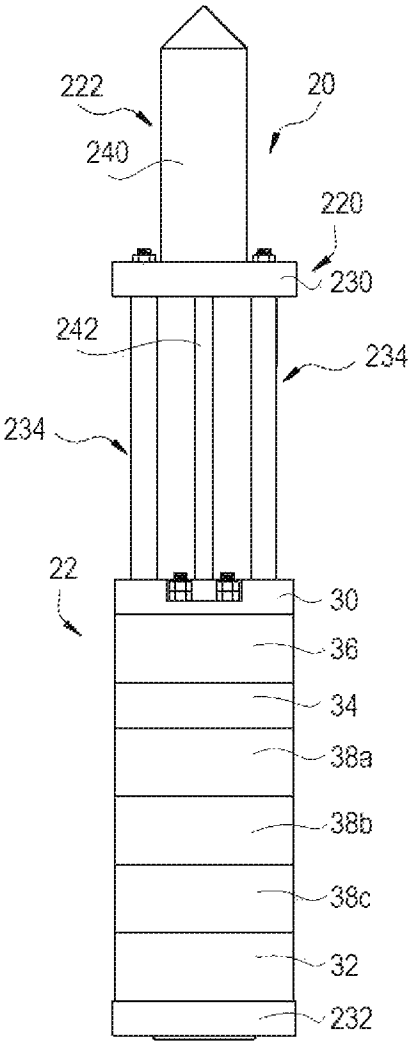
FIGS. 3A, 3B, 3C, and 3D are front elevation views of the first example hydraulic impact hammer of the present invention in which the first example ram assembly is in first, second, third, and fourth configurations, respectively.

Referring initially to FIGS. 1, 2, 3A, 3B, 3C, and 3D of the drawing, depicted therein is a first example hydraulic impact hammer 20 comprising a first example ram assembly 22 constructed in accordance with, and embodying, the principles of the present invention. The first example ram assembly 22 can be configured in a first configuration with four ram plates (FIG. 3A), in a second configuration with five ram plates (FIG. 3B), in a third configuration with six ram plates (FIG. 3C), or in a fourth configuration with seven ram plates (FIG. 3D). The fourth configuration of the first example ram assembly 22 will be described herein in detail, with the understanding that the explanation of the first example ram assembly 22 in the fourth configuration also applies to the first example ram assembly in the first, second, and third configurations.

Figure 4:
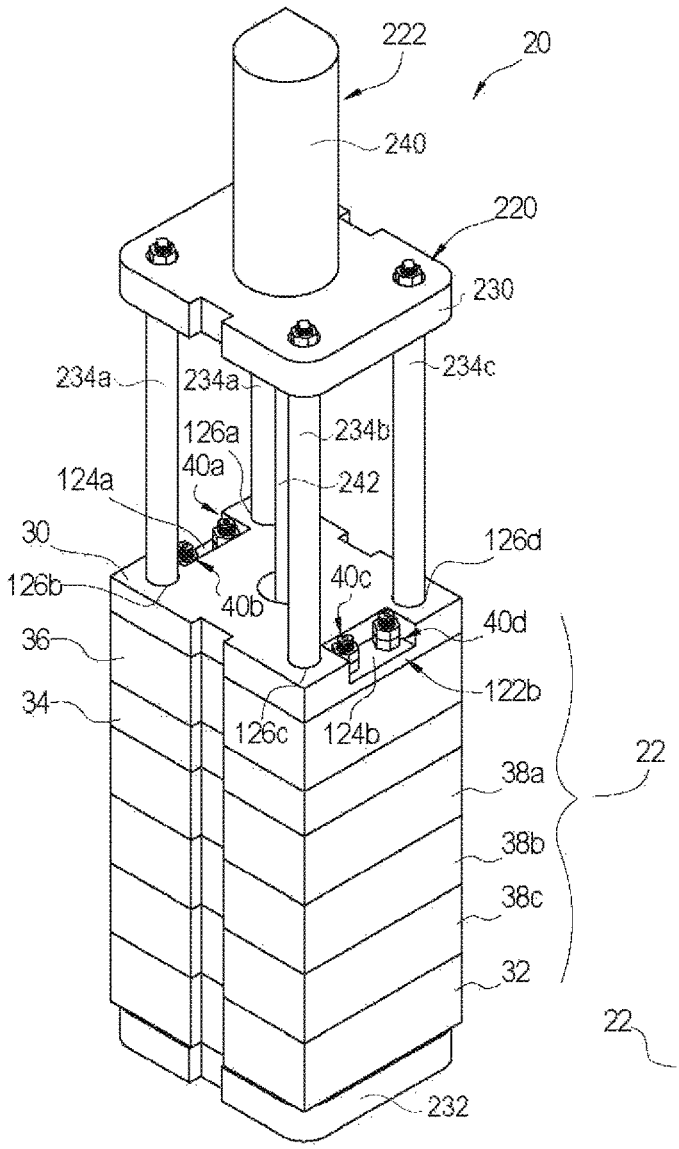
FIG. 4 is a perspective view of the first example hydraulic impact hammer in the fourth configuration.
Figure 5:
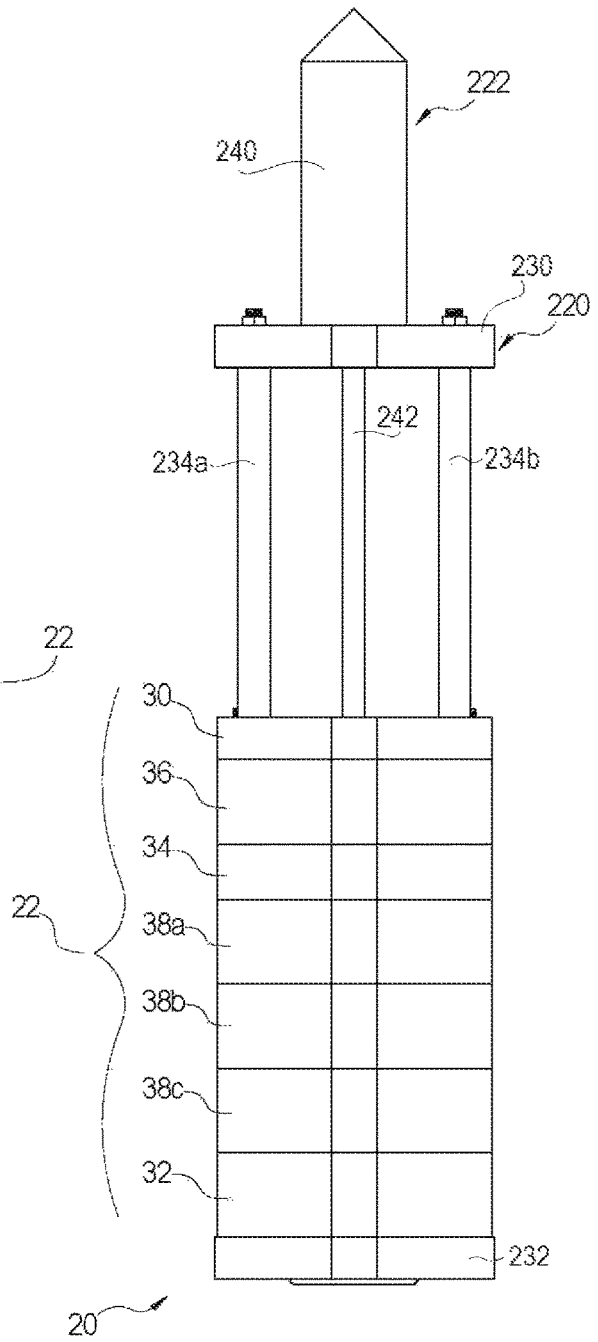
FIG. 5 is a perspective view of the first example hydraulic impact hammer in the fourth configuration.

Referring now more specifically to FIGS. 4 and 5, it can be seen that, in the fourth configuration, the first example ram assembly 22 comprises a top plate 30, a bottom plate 32, a lift plate 34, and, optionally, a primary plate 36 and one or more add plates 38. In the first example ram assembly 22, the plates 30, 32, 34, and 36 and the optional add plates 38 are held together, as perhaps best shown in FIGS. 4 and 7, by at least one ram wire rope assembly 40. The at least one ram wire rope assembly 40 holds the plates 30, 32, 34, 36, and 38 together such that the plates 30, 32, 34, 36, and 38 move in unison when lifted and dropped by the first example hydraulic impact hammer.

With the foregoing understanding of the construction and operation of the present invention in mind, the details of the first example hydraulic impact hammer 20 and the first example ram assembly 22 will now be described in further detail. In the following discussion, certain reference characters will be used with and without a letter appendix. When used with a letter appendix, such reference characters refer to a specific instance of an element. When used without a letter appendix, such reference characters generally refer to that same element.

Figure 3C:
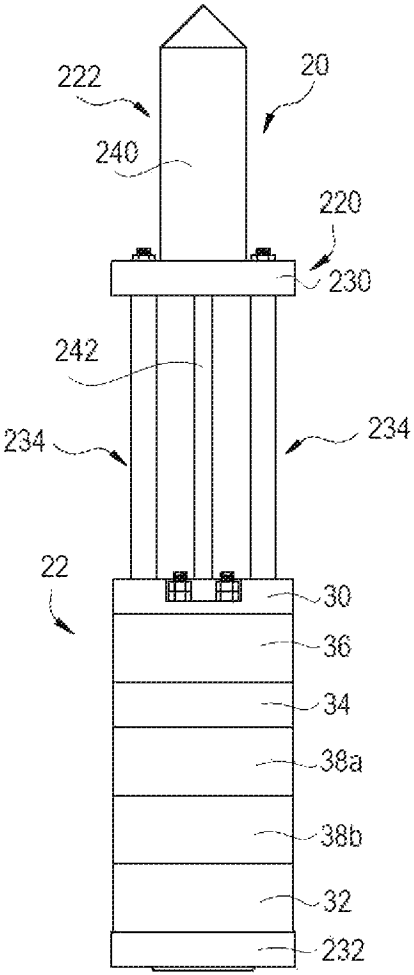
Figure 3B:
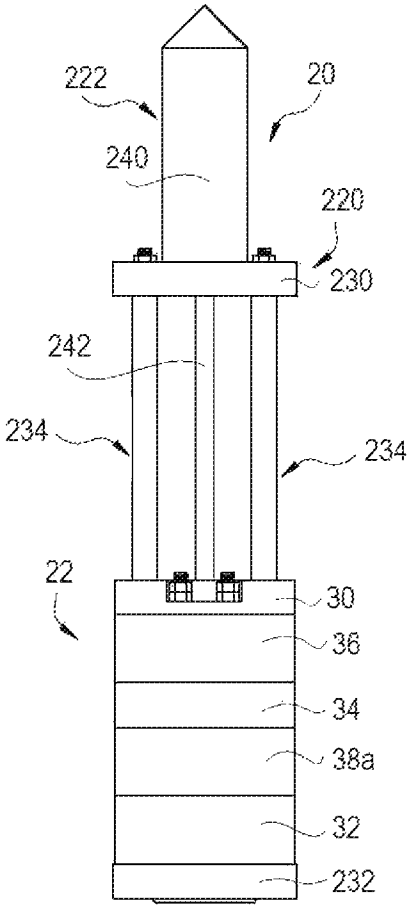
Figure 3A:
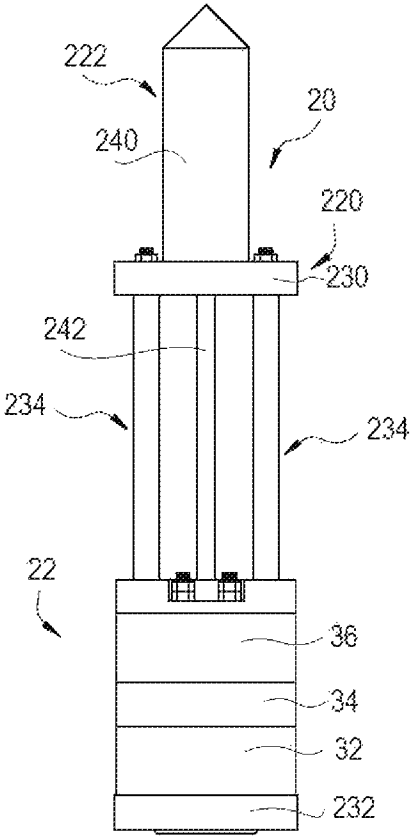

In the first example ram assembly 22, the top plate 30, bottom plate 32, lift plate 34, and primary plate 36 may be referred to as "common plates" as these plates are common to all of the first, second, third, and fourth configurations. The add plates 38, on the other hand, are not required and may or may not be used in certain configurations of the first example ram assembly 22. Further, while the first example ram assembly 22 employs the primary plate 36 as a common plate, it is possible to embody a ram assembly of the present invention with just the top plate 30, bottom plate 32, and lift plate 34. In any event, the first example ram assembly 22 is configured to include the primary plate 36 and may be configured to include none of the add plates 38 (first configuration; FIG. 3A), one of the add plates 38 (second configuration; FIG. 3B), two of the add plates 38 (third configuration; FIG. 3C), or three of the add plates 38*a*, 38*b*, and 38*c* (fourth configuration; FIGS. 1, 2, 3D, 4, and 5.

Figure 6:
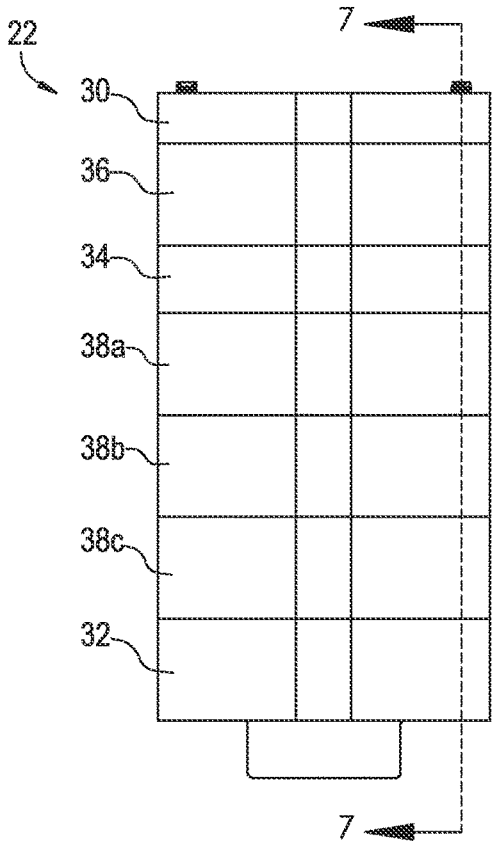
FIG. 6 is a front elevation view of the first example ram assembly in the fourth configuration.
Figure 7:
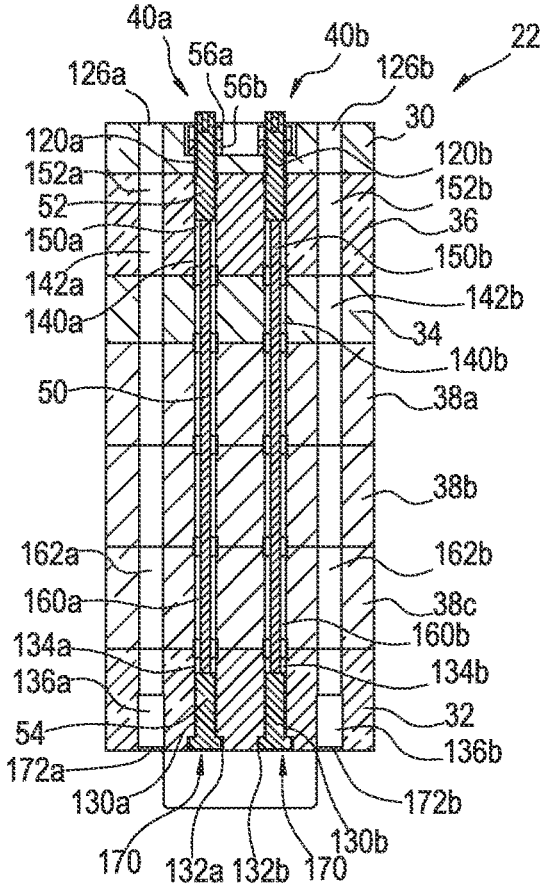
FIG. 7 is a section view taken along lines 7-7 in FIG. 6.
Figure 8:
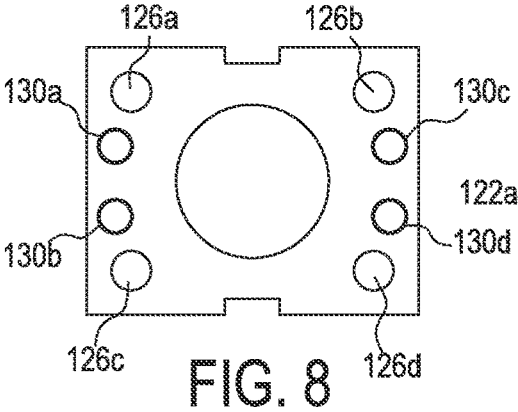
FIG. 8 is a bottom plan view of the first example ram assembly.
Figure 9:
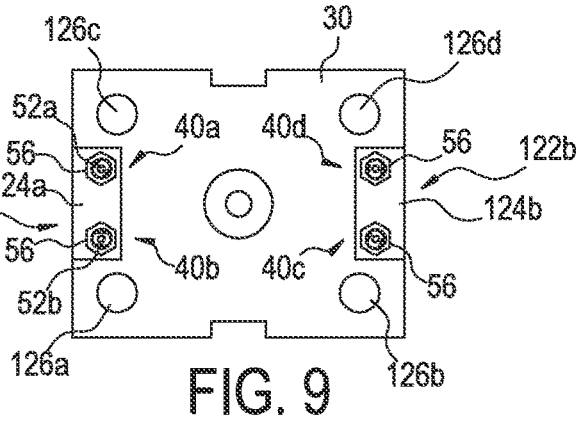
FIG. 9 is a top plan view of the first example ram assembly.

Typically, but not necessarily, a plurality (i.e., two or more) ram wire rope assemblies 40 are used. FIGS. 4, 6, and 7 illustrate that the first example ram assembly 22 comprises first, second, third, and fourth ram wire rope assemblies 40*a*, 40*b*, 40*c*, and 40*d*.

Figure 10:
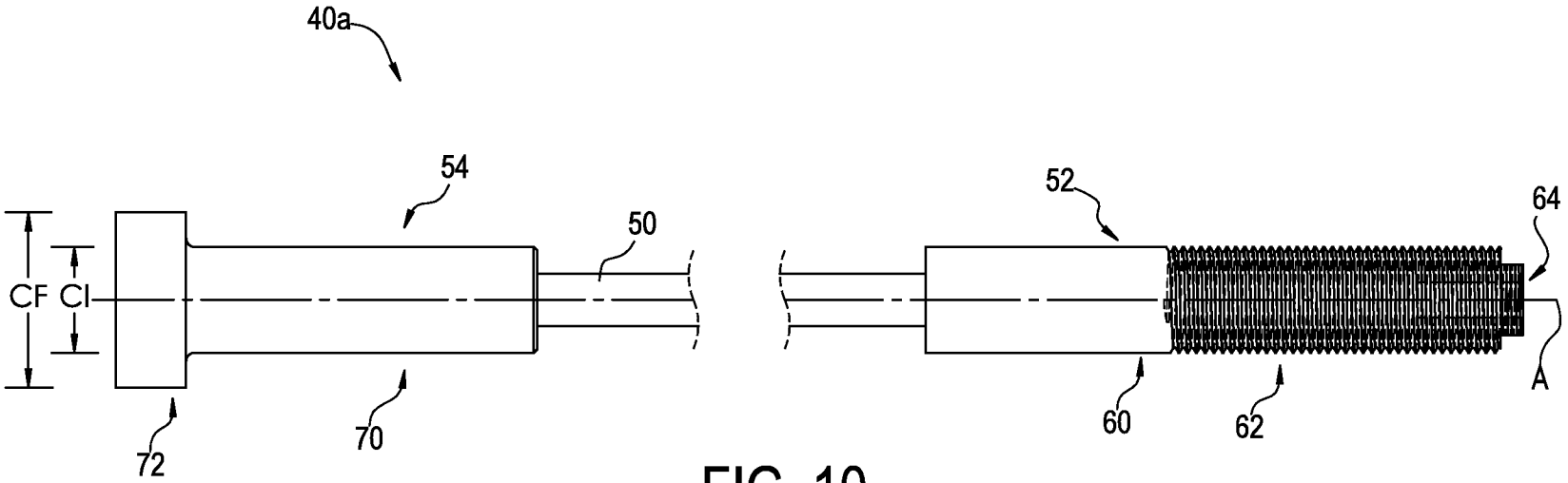
FIG. 10 is a side elevation view of a first example ram wire rope assembly of the first example ram assembly.
Figure 11:
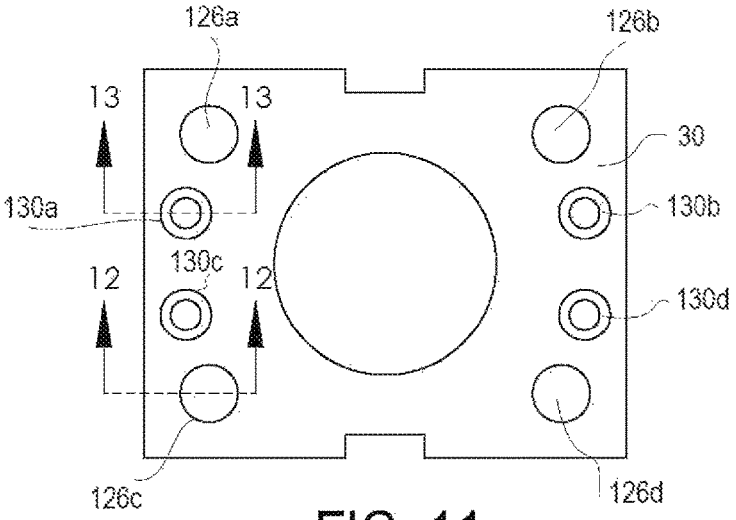
FIG. 11 is a top plan view of the example top plate of the first example ram assembly.
Figure 12:
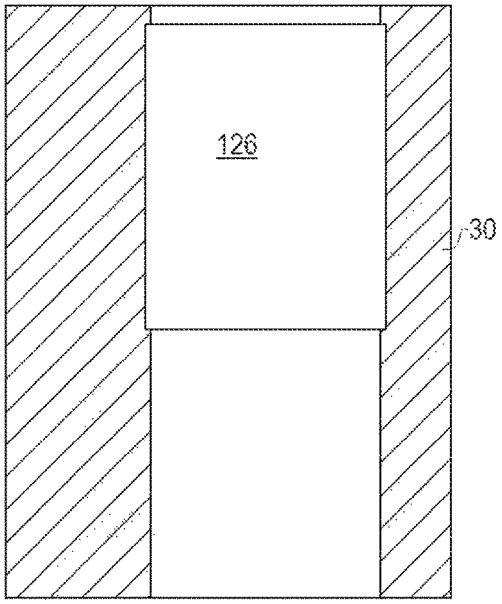
FIG. 12 is a section view taken along lines 12-12 in FIG. 11.
Figure 13:
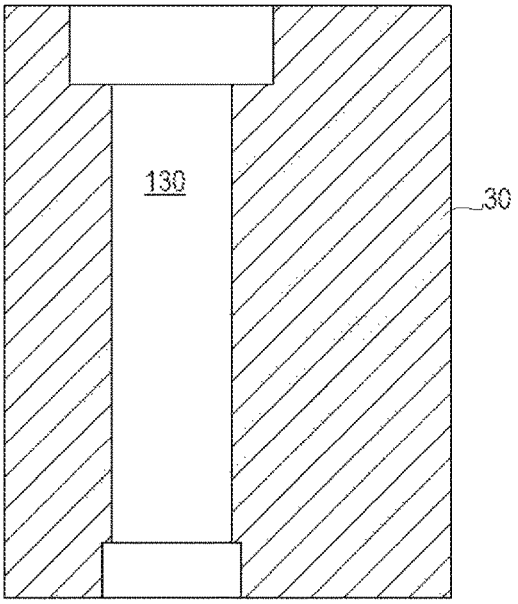
FIG. 13 is a section view taken along liens 13-13 in FIG. 11.
Figure 14:
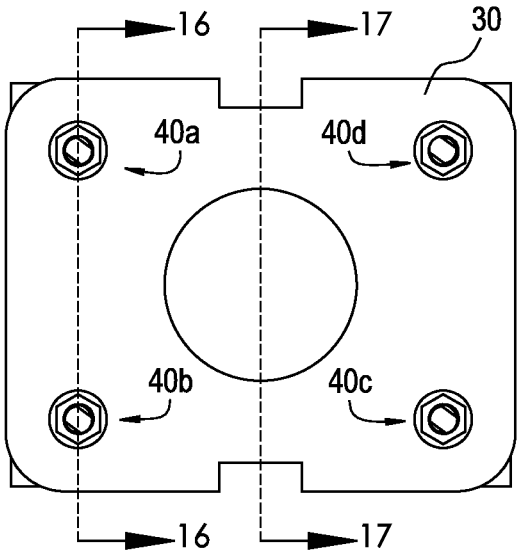
FIG. 14 is a top plan view of the first example hydraulic impact hammer.
Figure 15:
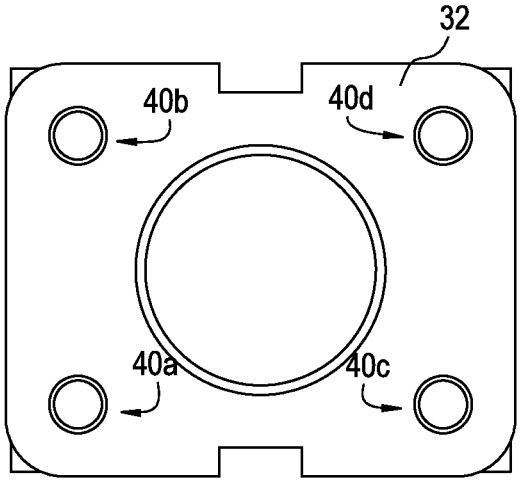
FIG. 15 is a bottom plan view of the first example hydraulic impact hammer.

FIG. 7 illustrates the first and second ram wire rope assemblies 40*a* and 40*b* in more detail. The ram wire rope assemblies 40 are or may be identical, and only the first ram wire rope assembly 40*a* will be described herein in detail. As shown in FIGS. 7 and 10, the first ram wire rope assembly 40*a* comprises a wire rope member 50, a head member 52, a foot member 54, and one or more ram wire rope nuts 56. The wire rope member 50 defines a rope longitudinal axis A. FIG. 10 further illustrates that the head member 52 comprises a head inner portion 60, a head threaded portion 62, and a head screw cavity 64, that the foot member 54 defines a foot inner portion 70 and a foot engaging portion 72, and that an effective cross-sectional area CF of the foot engaging portion 72 orthogonal to the wire rope longitudinal axis A is larger than an effective cross-sectional area CI of the foot inner portion 70 orthogonal to the rope longitudinal axis A. As shown in FIG. 7, the example first ram wire rope assembly 40*a* comprises first and second ram wire rope nuts 56*a* and 56*b* adapted to threadingly engage the head threaded portion 62. The wire rope member 50 is rigidly connected to at least the foot inner portion 70 and at least the head inner portion 60 such that forces displacing the foot member 64 and head member 62 away from each other are effectively applied as tension loads on the wire rope member 50.

Figure 17:
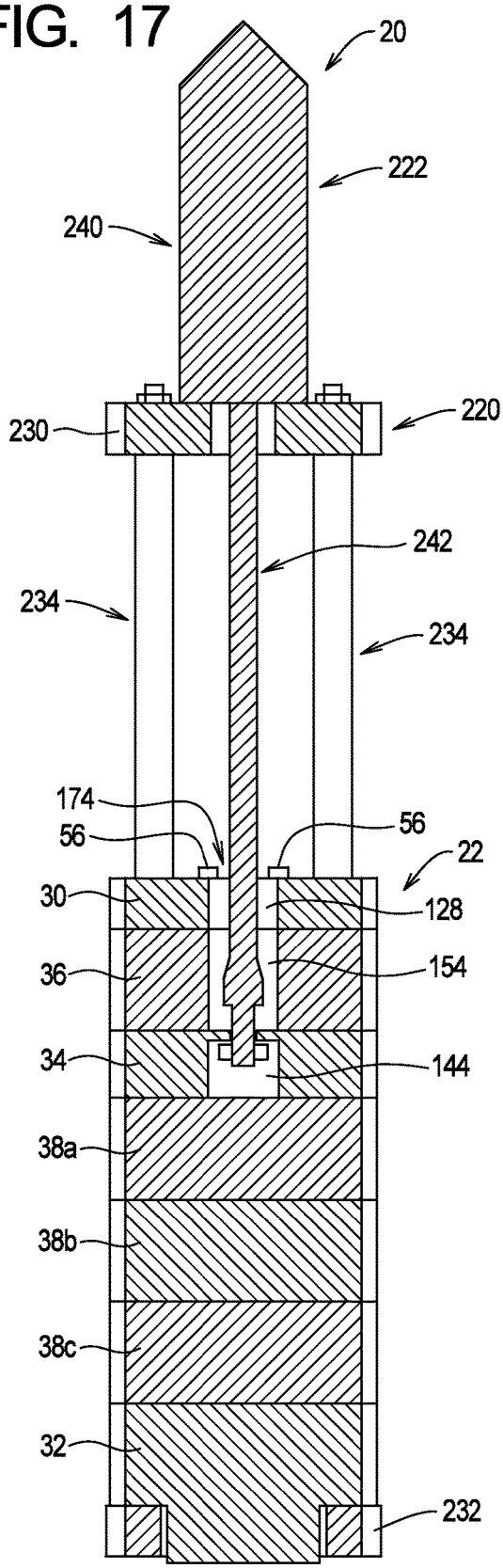
FIG. 17 is a section view taken along lines 17-17 in FIG. 14.

FIG. 7 illustrates that the example top plate 30 defines at least one clamp opening 120, at least one notch 122 defining a clamp surface 124, at least one top plate cage opening 126, and at least one top plate lift opening 128. The example bottom plate 32 defines at least one anchor opening 130 defining an anchor bore portion 132 and an inner bore portion 134 and at least one bottom plate cage opening 136. The example lift plate 34 defines at least one lift plate ram cable opening 140, at least one lift plate cage opening 142, and at least one lift plate lift opening 144 (FIG. 17). The example primary plate 36 defines at least one primary plate ram cable opening 150, at least one primary plate cage opening 152, and at least one primary plate lift opening 154 (FIG. 17). Each of the optional add plates 38 defines at least one add plate ram cable opening 160 and at least one add plate cage opening 162.

FIG. 7 further illustrates that the plates 30, 32, 34, 36, and 38 are stacked such that clamp openings 120, anchor openings 130, the lift plate ram cable openings 140, the primary plate ram cable openings 150, and the add plate ram cable openings 160, are aligned to define at least one ram cable passageway 170. The stacked plates 30, 32, 34, 36, and 38 further define at least one cage passageway 172 defined by the top plate cage opening(s) 126, bottom plate cage opening (s) 136, lift plate cage opening 142, primary plate cage opening 152, and add plate cage opening 162. The stacked plates 30, 34, and 36 further define at least one lift passageway 174 (FIG. 17) defined by the top plate lift opening 128, the lift plate lift opening 144, and the primary plate lift opening 154 (FIG. 17). As an alternative, the lift passageway may be configured to extend through lift openings formed in the bottom plate 32 and the add plates 38.

To assemble the first example ram assembly 22 in the configuration depicted in FIGS. 7 and 17, the head members 52 of the ram wire rope assembly(ies) 40 is(are) inserted in an insertion direction through the bottom plate anchor opening(s) 130, the add plate ram cable opening(s) 160, the lift plate ram cable opening(s) 140, the primary plate ram cable opening(s) 150, and the top plate clamp opening 120 until the foot engaging portion 72 is within the anchor bore portion 132 of the anchor opening 130 and the head threaded portion 72 extends at least partly out of the top plate clamp opening 120. At this point, the foot engaging portion(s) 72 engage the bottom plate 32 to inhibit further movement of the ram wire rope assembly(ies) 40 in the insertion direction. The ram wire rope nut(s) 56 are then secured to the threaded portion(s) 62 to inhibit movement of the ram wire rope assembly(ies) 40 in a direction opposite the insertion direction. An appropriate torque is applied to the ram wire rope nut(s) 56 to ensure that a predetermined clamping force places the ram wire rope assembly(ies) under tension appropriate to inhibit movement of the plates 30, 32, 34, 36, and/or 38 during operation of the hydraulic impact hammer 20.

Referring now to FIGS. 1-5 and 14-17, the assembly of the first example hydraulic impact hammer 20, the connection of the first example ram assembly 22 with the first example hydraulic impact hammer 20, and the operation of the hydraulic impact hammer 20 will be described in further detail.

Figure 16:
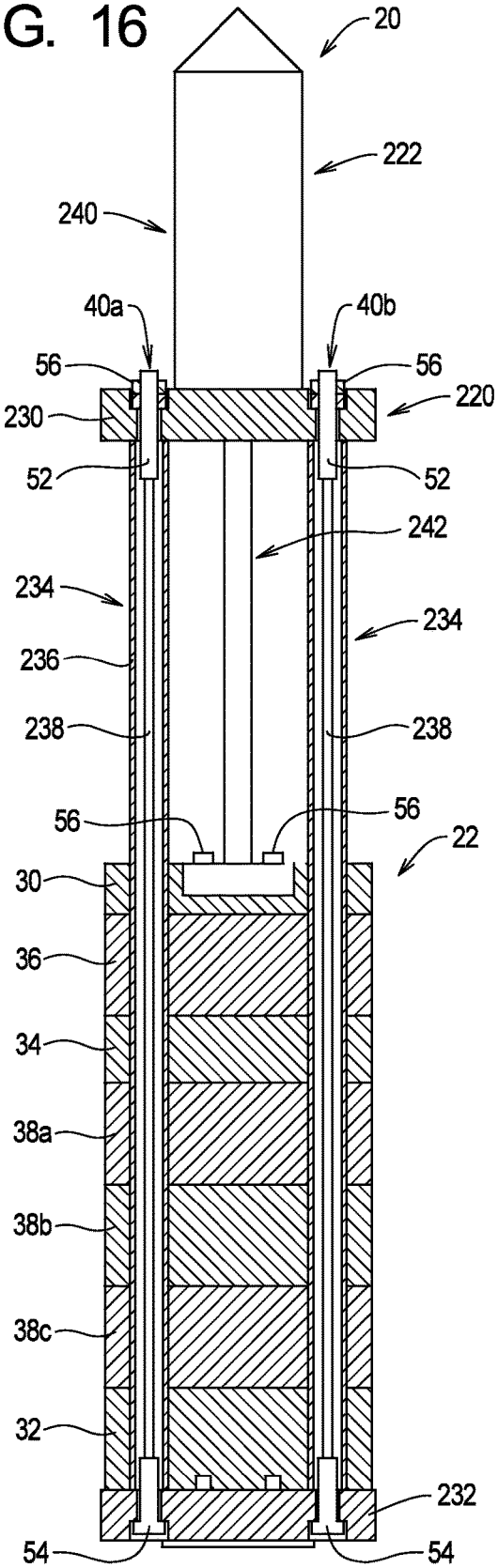
FIG. 16 is a section view taken along lines 16-16 in FIG. 14.

The example hydraulic impact hammer 20 comprises a cage assembly 220 and an actuator assembly 222. The example cage assembly 220 comprises an upper cage plate 230, a lower cage plate 232, and at least one cage support 234. The example cage assembly 220 comprises four of the cage supports 234. As shown in FIG. 16, the example cage supports 234 each comprise a cage support cylinder 236 and a cage wire rope assembly 238. The cage support cylinder(s) 236 is(are) arranged to space the upper cage plate 230 and the lower cage plate 232 a minimum predetermined distance from each other. The cage wire rope assembly(ies) 238 arranged to fix the upper cage plate 230 and the lower cage plate 232 at the minimum predetermined distance. The example actuator assembly 222 comprises an actuator cylinder assembly 240 and an actuator rod assembly 242.

The cage assembly 220 is assembled such that a portion of each cage support 234 is arranged within one cage passageway(s) 172 defined by the first example ram assembly 22. The cage passageway(s) 172 is(are) sized and dimensioned relative to the cage supports 234 such that the first example ram assembly 22 is capable of moving between a lower position as shown and an upper position (not shown) in a conventional manner.

Further, with the first example ram assembly 22 supported by the cage assembly 220, the actuator rod assembly 242 extends from the actuator cylinder assembly 242 and at least partly into the lift passageway 174 and is operatively connected to the example lift plate 34. Operation of the actuator assembly 222 to retract the actuator rod assembly 242 thus displaces the first example ram assembly 22 from the lower position to the upper position. Releasing the lifting force applied by the actuator assembly 222 allows gravity to displace the first example ram assembly from the upper position to the lower position.

As is or may be conventional, a retainer ring (not shown) supported by the lower cage plate 232 aligns an elongate member (not shown) to be driven, and a strike plate (not shown) transfers the impact of the first example ram assembly 22 to the elongate member to be driven.

What is claimed is:

1. A ram assembly for use by a system for driving elongate members into the earth comprising an actuator rod assembly, the ram assembly comprising:

a top plate defining at least one clamp opening and at least one top plate lift opening;

a bottom plate defining at least one anchor opening;

a lift plate defining at least one lift plate ram cable opening;

at least one add plate defining at least one add plate ram cable opening; and at least one ram wire rope assembly; wherein the at least one add plate is arranged between the top plate and the bottom plate;

the at least one ram wire rope assembly extends through the at least one lift plate ram cable opening and the at least one add plate ram cable opening and between the at least one clamp opening and the at least one anchor opening to inhibit movement of the top plate, the bottom plate, the lift plate, and the at least one add plate relative to each other; and the at least one top plate lift opening is sized and dimensioned to allow at least a portion of the actuator rod assembly to extend through the top plate; and the lift plate is adapted to be secured relative to the actuator rod assembly.

2. A ram assembly as recited in claim 1, further comprising at least one primary plate arranged between the lift plate and the top plate, wherein:

each primary plate defines at least one primary plate ram cable opening and at least one primary plate lift opening;

the at least one ram wire rope assembly extends through the at least one primary plate ram cable opening; and the at least one primary plate lift opening is sized and dimensioned to allow at least a portion of the actuator rod assembly to extend through the at least one primary plate.

3. A ram assembly as recited in claim 2, in which:

the top plate defines at least one top plate cage opening;

the bottom plate defines at least one bottom plate cage opening;

the lift plate defines at least one lift plate cage opening; and the at least one primary plate defines at least one primary plate cage opening.

4. A ram assembly as recited in claim 2, in which:

the top plate defines at least one top plate cage opening;

the bottom plate defines at least one bottom plate cage opening;

the lift plate defines at least one lift plate cage opening;

the at least one primary plate defines at least one primary plate cage opening; and the at least one add plate defines at least one add plate cage opening.

5. A ram assembly as recited in claim 1, in which the at least one add plate comprises a plurality of add plates arranged between the bottom plate and the lift plate, wherein:

each of the plurality of add plates defines at least one add plate ram cable opening; and the at least one ram wire rope assembly extends through the at least one add plate ram cable opening formed in each of the plurality of add plates.

6. A ram assembly as recited in claim 5, in which:

the top plate defines at least one top plate cage opening;

the bottom plate defines at least one bottom plate cage opening;

the lift plate defines at least one lift plate cage opening; and each of the plurality of add plates defines at least one add plate cage opening.

7. A ram assembly as recited in claim 1, in which:

the top plate defines at least one top plate cage opening;

the bottom plate defines at least one bottom plate cage opening; and the lift plate defines at least one lift plate cage opening.

8. A method of driving elongate members into the earth comprising the steps of:

providing a top plate defining at least one clamp opening and at least one top plate lift opening;

providing a bottom plate defining at least one anchor opening;

providing a lift plate defining at least one lift plate ram cable opening;

providing at least one add plate defining at least one add plate ram cable opening;

arranging the at least one add plate between the top plate and the bottom plate;

arranging at least one ram wire rope assembly to extend through the at least one lift plate ram cable opening and the at least one add plate ram cable opening and between the at least one clamp opening and the at least one anchor opening to inhibit movement of the top plate, the bottom plate, the lift plate, and the at least one add plate relative to each other; and extending at least a portion of the actuator rod assembly through the at least one top plate lift opening;

securing the lift plate relative to the actuator rod assembly; and driving the elongate member into the earth.

9. A method as recited in claim 8, further comprising the steps of:

arranging at least one primary plate between the lift plate and the top plate, where each primary plate defines at least one primary plate ram cable opening and at least one primary plate lift opening;

extending the at least one ram wire rope assembly through the at least one primary plate ram cable opening;

sizing and dimensioning the at least one primary plate lift opening to allow at least a portion of the actuator rod assembly to extend through the at least one primary plate; and extending at least a portion of the actuator rod assembly through the at least one primary plate.

10. A method as recited in claim 9, in which:

the top plate defines at least one top plate cage opening;

the bottom plate defines at least one bottom plate cage opening;

the lift plate defines at least one lift plate cage opening; and the at least one primary plate defines at least one primary plate cage opening.

11. A method as recited in claim 8, in which:

the top plate defines at least one top plate cage opening;

the bottom plate defines at least one bottom plate cage opening; and the lift plate defines at least one lift plate cage opening.

12. A method as recited in claim 8, further comprising the step of providing at least one primary plate, in which:

the top plate defines at least one top plate cage opening;

the bottom plate defines at least one bottom plate cage opening;

the lift plate defines at least one lift plate cage opening;

the at least one primary plate defines at least one primary plate cage opening; and the at least one add plate defines at least one add plate cage opening.

13. A system for driving elongate members into the earth comprising:

a hydraulic impact hammer comprising a cage assembly, and an actuator assembly comprising an actuator and an actuator rod assembly; and a ram assembly comprising a top plate defining at least one clamp opening, at least one top plate lift opening, and at least one top plate cage opening, a bottom plate defining at least one anchor opening and at least one bottom plate cage opening, a lift plate defining at least one lift plate ram cable opening and at least one lift plate cage opening, at least one add plate defining at least one add plate ram cable opening and at least one add plate cage opening, and at least one ram wire rope assembly; wherein the at least one add plate is arranged between the top plate and the bottom plate;

the at least one ram wire rope assembly extends through the at least one lift plate ram cable opening and the at least one add plate ram cable opening and between the at least one clamp opening and the at least one anchor opening to inhibit movement of the top plate, the bottom plate, the lift plate, and the at least one add plate relative to each other; and at least a portion of the cage assembly extends through the at least one top plate cage opening, the at least one bottom plate cage opening, the at least one lift plate cage opening, and the at least one add plate cage opening to allow movement of the ram assembly relative to the cage assembly;

the at least one top plate lift opening is sized and dimensioned to allow at least a portion of the actuator rod assembly to extend through the top plate;

the lift plate is adapted to be secured relative to the actuator rod assembly.

14. A system for driving elongate members into the earth as recited in claim 13, further comprising at least one primary plate arranged between the lift plate and the top plate, wherein:

each primary plate defines at least one primary plate ram cable opening, at least one primary plate lift opening, and at least one primary plate cage opening;

the at least one ram wire rope assembly extends through the at least one primary plate ram cable opening;

the at least one primary plate lift opening is sized and dimensioned to allow at least a portion of the actuator rod assembly to extend through the at least one primary plate, and at least a portion of the cage assembly extends through the at least one primary plate cage opening to allow movement of the ram assembly relative to the cage assembly.

15. A system for driving elongate members into the earth as recited in claim 13, wherein the at least one add plate comprises a plurality of add plates arranged between the bottom plate and the lift plate, wherein:

each add plate defines at least one add plate ram cable opening and at least one add plate cage opening;

the at least one ram wire rope assembly extends through the at least one add plate ram cable opening; and at least a portion of the cage assembly extends through the at least one add plate cage opening to allow movement of the ram assembly relative to the cage assembly.

* * * * *